United States Patent [19]

McLaughlin et al.

[11] 4,135,169

[45] Jan. 16, 1979

[54] PRE-TR HIGH POWER/INTERMEDIATE POWER STAGE APPARATUS

[75] Inventors: James F. McLaughlin, Severna Park; Theodore M. Nelson, Ellicott City, both of Md.

[73] Assignee: The United States of America as represented by the Secretary of the Air Force, Washington, D.C.

[21] Appl. No.: 776,390

[22] Filed: Mar. 10, 1977

[51] Int. Cl.[2] ..... H01P 1/14

[52] U.S. Cl. ..... 333/13; 315/39

[58] Field of Search ..... 333/13; 315/39

[56] References Cited

U.S. PATENT DOCUMENTS

| | | | |
|---|---|---|---|
| 3,753,158 | 8/1973 | Prescott | 333/13 |
| 4,027,255 | 5/1977 | Blakeney et al. | 333/13 |

*Primary Examiner*—Paul L. Gensler

*Attorney, Agent, or Firm*—Joseph E. Rusz; William Stepanishen

[57] ABSTRACT

A pre-TR high power/intermediate power stage apparatus for receiver protectors utilizing a single quartz vial filled with a halogen gas and having a predetermined configuration to provide the dual function of a high power pre-TR and the intermediate power stage.

4 Claims, 10 Drawing Figures

PRE-TR HIGH POWER/INTERMEDIATE POWER STAGE APPARATUS

STATEMENT OF GOVERNMENT INTEREST

The invention described herein may be manufactured and used by or for the Government for governmental purposes without the payment of any royalty thereon.

BACKGROUND OF THE INVENTION

The present invention relates broadly to a microwave input stage receiver protector, and in particular to a single stage pre-TR high power/intermediate power stage receiver protector apparatus.

In the present state-of-the-art waveguide receiver protectors for high power radar systems, there are stringent requirements for fast between pulse recovery times. The prior art receiver protector apparatus generally utilized a separate high power capsule stage and capillary stage as the pre-TR and intermediate power stages. The high power pre-TR vial front stage and intermediate power capillary stage use halogen gas fills in order to achieve the fast sub-microsecond recovery times. However, because of their reactive nature, the halogen gases must be enclosed in quartz within these stages. The low power radioactive ignitor stage and diode limiter back stage, reduce leakage power to an acceptable level while not adversely effecting recovery time.

For the lowest firing power and leakage power, either one-quarter or three-quarter wavelength interstage spacing at center band frequency must be used. Since the vial diameter itself is almost one-quarter wavelength at C-band, and is one-quarter wavelength at X-band, three-quarter wavelength spacing must be used between vial and capillary stages at C-band frequencies and higher.

The capillary stage is relatively expensive to build since extremely fine tolerances must be held on both the quartz capillary and its surrounding aluminum fixture. It will be noted that the thin wall quartz tubing of the quartz capillary is the most delicate member in the entire receiver protector. Its breakage results in failure of the receiver protector due to poor recovery time and high leakage power.

SUMMARY

The present invention utilizes a quartz vial filled with a halogen gas to provide the combined characteristics of a high power pre-TR vial stage and an intermediate power capillary stage for a waveguide receiver protector. The quartz vial has two wall thickness which are diametrically opposite. The vial is aligned in a mounting fixture with a pair of slots of different size. The slot sizes and the quartz wall thickness may be varied with respect to the operating frequency of the receiver.

It is one object of the present invention, therefore, to provide an improved waveguide receiver protector apparatus wherein a single stage provides the dual characteristics of a high power pre-TR vial stage and an intermediate power capillary stage.

It is another object of the invention to provide an improved waveguide receiver protector apparatus wherein the quartz vial diameter is held to one-quarter wavelength with a resultant reduction in length and weight.

These and other advantages, features and objects of the invention will become more apparent from the following description taken in connection with the illustrative embodiment in the accompanying drawings.

DESCRIPTION OF THE PREFERRED EMBODIMENT

Figure 1A:
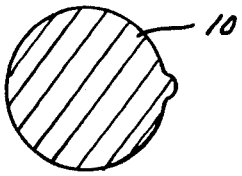
FIGS. 1*a*–1*h* are the various fabrication steps of the quartz vial with FIGS. 1*f*–*h* being side views respectively of FIGS. 1*c*–*e*.
Figure 1B:
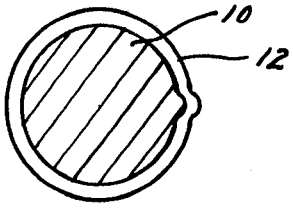
Figure 1C:
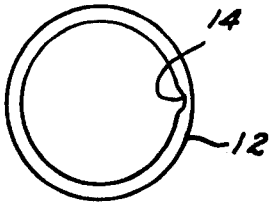
Figure 1F:
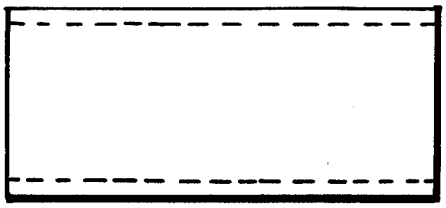
Figure 1D:
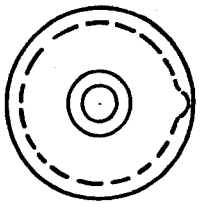
Figure 1G:
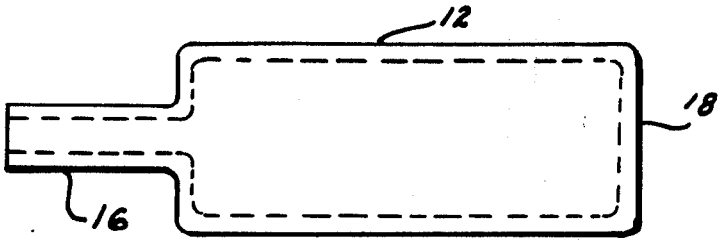
Figure 1E:
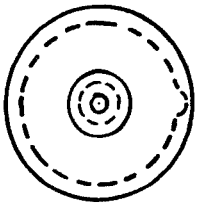
Figure 1H:
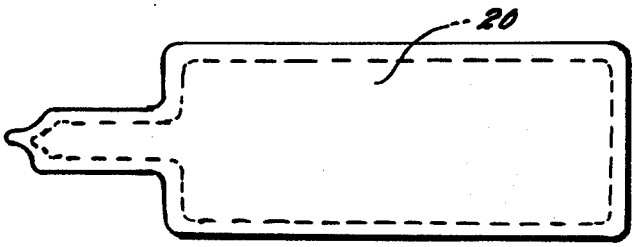

Referring now to FIGS. 1*a*–*h*, there is shown the steps in the fabrication of the quartz vial for the pre-TR/intermediate power stage. In FIG. 1*a* is shown the mandrel 10 about which the quartz vial apparatus will be formed. The second step in the fabrication process involves placing a quartz cylinder 12 over the mandrel 10 and shrinking the cylinder 12 onto the mandrel 10 as shown in FIG. 1*b*. The quartz cylinder 12 has a wall thickness greater than 0.016. The mandrel is machined so that a ridge runs down one side, the height being approximately 0.010. This ridge is clearly shown in FIGS. 1*a* and 1*b*. The outside diameter of the quartz cylinder is then centerless ground until the desired diameter, 0.400, is obtained. This dimension is held extremely tight, ±, 0.0001, so that the completed vial may be eventually shrunk fit into the aluminum mount. Next, the quartz cylinder is removed from the mandrel so that an end plate and exhaust tubing may be glassed onto the proper length of the ground cylinder. There is shown in FIG. 1*c* the quartz cylinder 12 after it has been centerless ground and removed from the mandrel. The shaped section 14 forms a longitudinal groove in the inner surface of the quartz cylinder 12 which is clearly visible. The quartz vial wall thickness at the point 14 is reduced by a predetermined amount. The depth of the longitudinal cavity at point 14 varies with the operating frequency. A side view of the quartz vial is given in FIG. 1*f*. In FIGS. 1*d*, 1*g* there is shown the quartz cylinder 12 with an exhaust tip 16 and an end plate 18 glassed into position. After cleaning and radioactivation, the vial is vacuum baked, filled to an appropriate pressure, usually about 10 torr, with the proper halogen gas and then tipped off. In FIGS. 1*e*, 1*h* there is shown respectively the quartz vial apparatus filled with a halogen gas 20. The quartz vial is now ready to be inserted into the aluminum mount.

Figure 2:
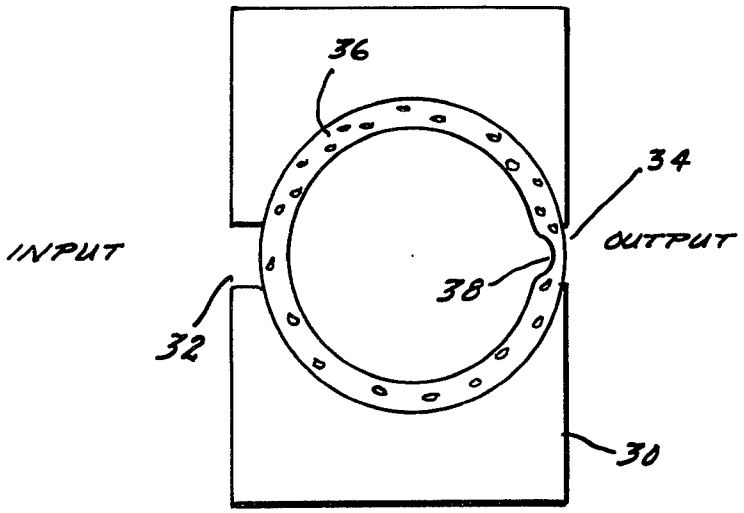
FIG. 2 is a cross-sectional view of the quartz vial apparatus.

There is shown in FIG. 2 the vial which is positioned in the mount 30 having a first slot 32 and a second slot 34. The mount 30 may be a precision based aluminum mount wherein in the first slot 32 has a dimension of 0.500 by 0.040 and the second slot has a dimension of 0.300 by 0.020. All dimensions given are in inches. The halogen gas-filled sealed quartz cylinder 36 is positioned with the mount 30 such that the thinner section 38 is opposite the smaller second slot 34. The larger slot 32 which is opposite the full quartz thickness, will then be the pre-TR stage, and the other slot 34 will be the intermediate power stage. The slot sizes and quartz thicknesses are chosen so that the stages can be properly tuned and still provide low enough firing power. The mounting means 30 has the same outside dimension as the height of the waveguide 42 shown in FIG. 3. The outside diameter of the quartz cylinder 36 is equal in size to the inside diameter of the mount as shown for example in FIG. 3. The halogen gas which is chlorine at a 10 torr pressure, will compliment the present design and in addition will provide the rapid recovery times demanded in many of today's radars.

Figure 3:
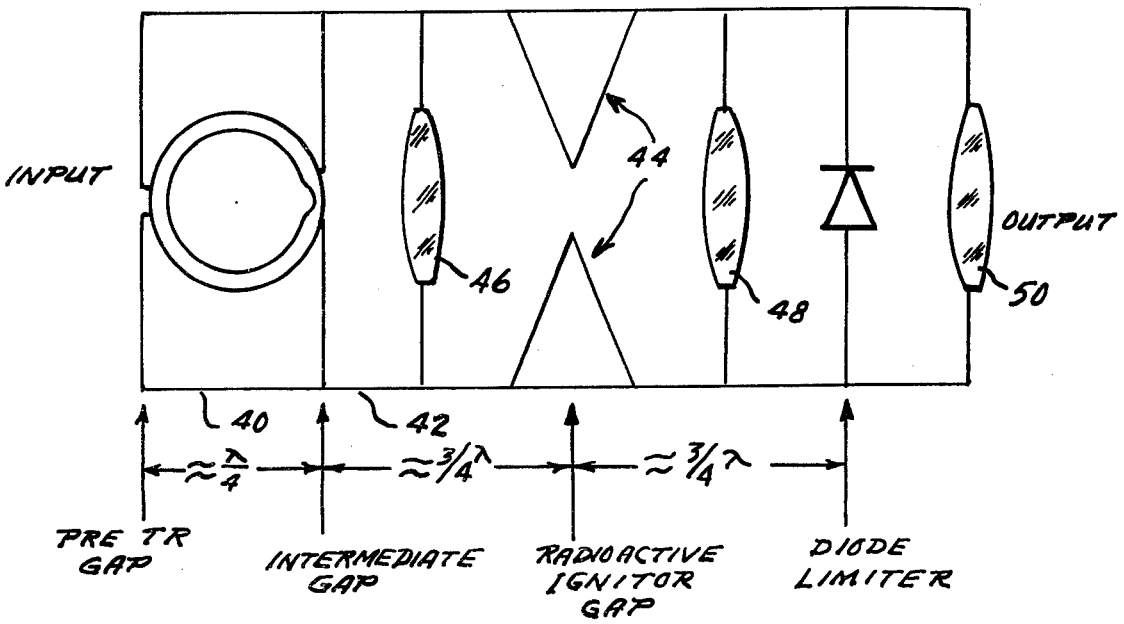
FIG. 3 is a cross-sectional view of a completely assembled waveguide receiver protector apparatus.

Turning now to FIG. 3, there is shown an assembled waveguide receiver protector apparatus. The quartz vial apparatus 40 is positioned in front of a waveguide 42 and has a dimension of approximately one-quarter wavelength. A radioactive ignitor gap device 44 is positioned in the waveguide 42 and has a pair of glass windows 46, 48. A diode limiter is positioned in the waveguide between the glass window 48 and the mica window 50 which at the output of the waveguide receiver protector apparatus.

Although the invention has been described with reference to a particular embodiment, it will be understood to those skilled in the art that the invention is capable of a variety of alternative embodiments within the spirit and scope of the appended claims:

What is claimed is:

1. A pre-TR high power/intermediate power stage apparatus for receiver protectors comprising in combination:

a quartz cylinder having a longitudinal groove in its inner surface, said quartz cylinder being sealed at both ends, said quartz cylinder containing a halogen gas at a predetermined pressure, said quartz cylinder having a predetermined diameter, and a means for mounting said quartz cylinder, said mounting means substantially surrounding said quartz cylinder, said mounting means having a first and second slot, therein, positioned diametrically opposite each other on said quartz cylinder, said first slot being larger than said second slot, said second slot being adjacent to said longitudinal groove in said quartz cylinder, said first and second slot being parallel to each other and to the longitudinal axis of said quartz cylinder, said first and second slot being in a same plane with said longitudinal groove in said quartz cylinder, said mounting means being connected to and in front of a receiver waveguide protector means, said mounting means having the same outside dimension as said receiver waveguide protector means, said quartz cylinder having its outside diameter equal in size to the inside dimension of said mounting means.

2. A pre-Tr high power/intermediate power stage apparatus as described in claim 1 wherein said predetermined pressure equals a pressure of 10 torr.

3. A pre-TR high power/intermediate power stage apparatus as described in claim 1 wherein said halogen gas is chlorine.

4. A pre-TR high power/intermediate power stage apparatus as described in claim 1 wherein said predetermined diameter equals one-quarter wavelength of the operating frequency.

* * * * *